US010099905B2

(12) United States Patent
Kuninaga et al.

(10) Patent No.: US 10,099,905 B2
(45) Date of Patent: Oct. 16, 2018

(54) CRANE

(71) Applicant: Hitachi Sumitomo Heavy Industries Construction Crane Co., Ltd., Taitou-ku, Tokyo (JP)

(72) Inventors: Hiroshi Kuninaga, Chita (JP); Akira Hanahara, Aichi (JP)

(73) Assignee: Hitachi Sumitomo Heavy Industries Construction Crane Co., Ltd., Tokyo (JP)

( * ) Notice: Subject to any disclaimer, the term of this patent is extended or adjusted under 35 U.S.C. 154(b) by 72 days.

(21) Appl. No.: 15/164,976

(22) Filed: May 26, 2016

(65) Prior Publication Data

US 2016/0347588 A1 Dec. 1, 2016

(30) Foreign Application Priority Data

May 27, 2015 (JP) ..... 2015-107238

(51) Int. Cl.

| | |
|---|---|
| ***B66C 23/70*** | (2006.01) |
| ***B66C 23/36*** | (2006.01) |
| ***B66C 23/34*** | (2006.01) |
| *B66C 23/82* | (2006.01) |

(52) U.S. Cl.

CPC ..... *B66C 23/365* (2013.01); *B66C 23/348* (2013.01); *B66C 23/70* (2013.01); *B66C 23/823* (2013.01)

(58) Field of Classification Search

CPC ..... B66C 23/365; B66C 23/70; B66C 23/348; B66C 23/00; B66C 23/42; B66C 23/62; B66C 23/64; B66C 23/66; B66C 23/68

See application file for complete search history.

(56) References Cited

U.S. PATENT DOCUMENTS 4,529,094 A * 7/1985 Wadsworth ..... B66C 23/26 212/232
7,341,158 B2 * 3/2008 Toudou ..... B66C 23/344 212/239
2003/0217985 A1 11/2003 Saint-Gerand (Continued)

FOREIGN PATENT DOCUMENTS

EP 1 364 906 A1 11/2003
JP 8-48489 A 2/1996

(Continued)

*Primary Examiner* — Minh Truong
*Assistant Examiner* — Juan J Campos, Jr.
(74) *Attorney, Agent, or Firm* — Crowell & Moring LLP

(57) ABSTRACT

A crane includes: a boom; a jib; a front post that is swingably attached to a tip end side of the boom; a rear post that is swingably attached to the tip end side of the boom; a post-side pendant member, with one end of the post-side pendant member being attached to a tip end of the rear post; a boom-side pendant member, with one end of the boom-side pendant member being attached to another end of the post-side pendant member, and another end of the boom-side pendant member being attached to the boom; and a post driving device having a link mechanism that rotates the rear post in a range including a position at which the rear post is swung down to the front post side and a position at which the rear post is swung down to the boom side, while the boom is held down in a horizontal position.

6 Claims, 14 Drawing Sheets

(56) References Cited

U.S. PATENT DOCUMENTS

| | | | | |
|---|---|---|---|---|
| 2008/0116161 | A1* | 5/2008 | Kurotsu | B66C 23/82 212/262 |
| 2010/0072156 | A1* | 3/2010 | Mentink | B66C 23/365 212/196 |
| 2014/0061144 | A1 | 3/2014 | Terauchi | |
| 2014/0083964 | A1* | 3/2014 | Kurotsu | B66C 23/66 212/177 |

FOREIGN PATENT DOCUMENTS

| | | | |
|---|---|---|---|
| JP | 10-310370 | A | 11/1998 |
| JP | 4777821 | B2 | 9/2011 |
| JP | 2013-49499 | A | 3/2013 |
| JP | 2014-43318 | A | 3/2014 |

* cited by examiner

CRANE

INCORPORATION BY REFERENCE

The disclosure of the following priority application is herein incorporated by reference: Japanese Patent Application No. 2015-107238 filed May 27, 2015

BACKGROUND OF THE INVENTION

1. Field of the Invention

The present invention relates to a crane.

2. Description of Related Art

A crane is provided with rear post support members (for example, cables) that support a rear post in a crane task (cargo-handling task). Japanese Laid-Open Patent Publication No. H8-48489 describes a method of mounting rear post support cables, in which a hydraulic cylinder is interposed between a rear post and a boom of a crane in such a manner that the rear post is rotatable, and rear post support cables that has been divided in two are connected to each other and are installed in the crane.

In the method described in the aforementioned publication, the rear post and a front post are attached to a boom head of a tower boom that has been rotated to lie down in a horizontal position. One end of one rear post support cable is engaged to a tip end of the rear post, while one end of the other rear post support cable is engaged to a cable mounting part of the tower boom. The other rear post support cable is laid on the tower boom so that the other end of this cable is arranged on the rear post side.

When the hydraulic cylinder is retracted, the rear post is rotated down to the tower boom side, so that two rear post support cables are coupled to each other. Thereafter, the hydraulic cylinder is extended so that the rear post raises up at a predetermined angle and the rear post support cables are installed.

SUMMARY OF THE INVENTION

In the method described in the aforementioned publication, it is necessary to generally vertically raise the rear post that is attached to the boom which has been swung down in a horizontal position, using an auxiliary crane (see Japanese Laid-Open Patent Publication No. H8-48489, Paragraph 0010 and FIG. 4).

A crane according to a first aspect of the present invention comprises: a boom; a jib that is attached to the boom so that the jib can be hoisted or lowered; a front post that is swingably attached to a tip end side of the boom and linked to the jib via a linking member; a rear post that is swingably attached to the tip end side of the boom, wherein a rope for hoisting or lowering the jip is wound between the rear post and the front post; a post-side pendant member, with one end of the post-side pendant member being attached to a tip end of the rear post; a boom-side pendant member, with one end of the boom-side pendant member being attached to another end of the post-side pendant member, and another end of the boom-side pendant member being attached to the boom; and a post driving device having a link mechanism that rotates the rear post in a range including a position at which the rear post is swung down to the front post side and a position at which the rear post is swung down to the boom side, while the boom is held down in a horizontal position.

DESCRIPTION OF EMBODIMENTS

Figure 1:
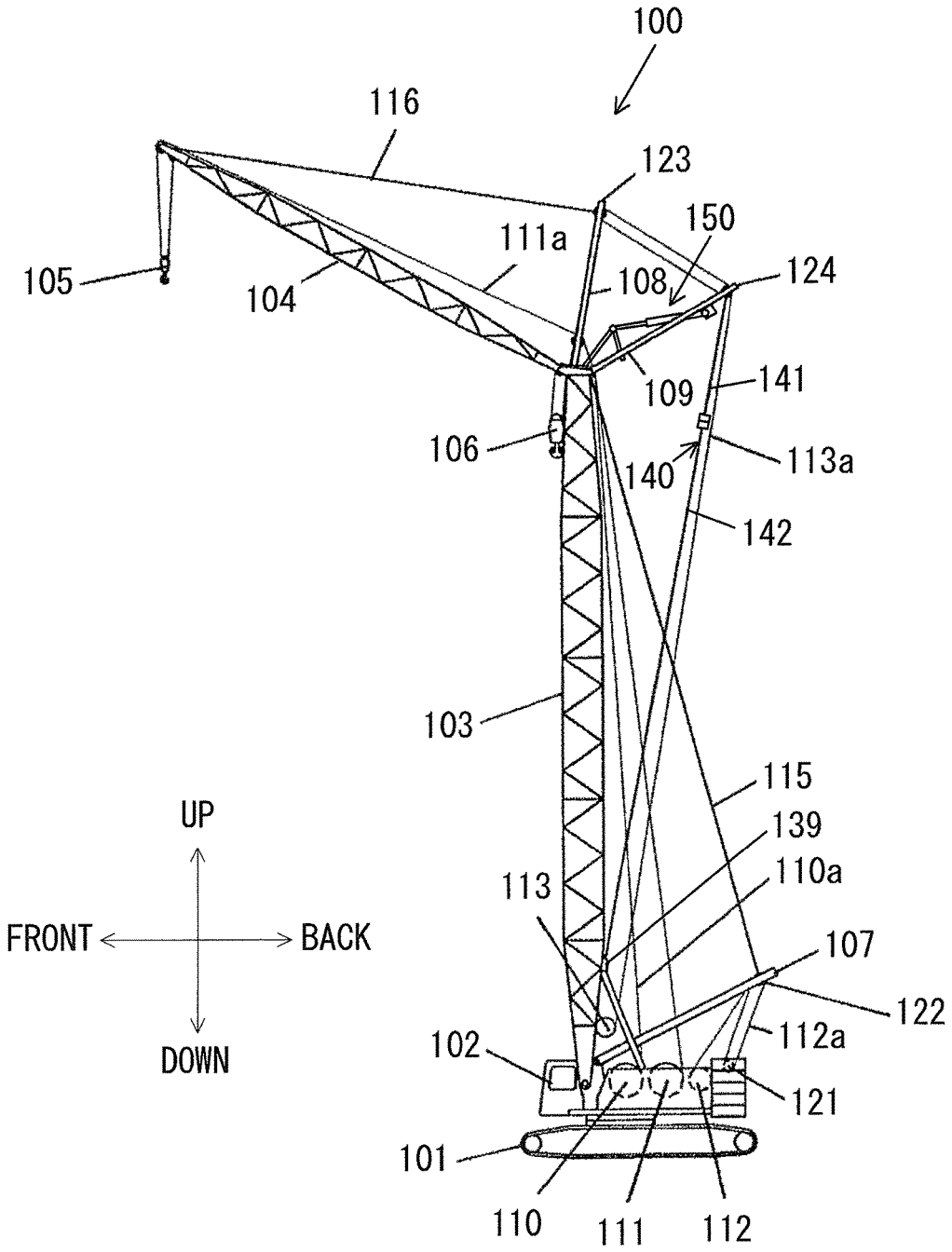
FIG. 1 is a side schematic view showing an appearance of a tower crane.

A crane according to one embodiment of the present invention will be described with reference to the drawings. For the sake of convenience, front, back, right, left, up and down directions of the crane will be defined as shown in the figures. FIG. 1 is a side schematic view showing an appearance of a tower crane. The tower crane (hereinafter referred to as the crane 100) has a travel body 101, a swing body (or revolving body) 102 that is swingably mounted on the travel body 101, a tower boom (hereinafter referred to as a boom 103) that is attached to a frame of the swing body 102 so that the boom 103 can be raised and lowered, and a tower jib (hereinafter referred to as a jib 104) that is attached to a tip end of the boom 103 so that the jib can be raised and lowered.

A hook (hereinafter referred to as a jib hook 105) for suspension by the jib is suspended from a tip end of the jib 104, and a hook (hereinafter referred to as a boom hook 106) for suspension by the boom is suspended from a tip end of the boom 103.

A front winch 110, a rear winch 111, and a boom hoist winch 112 are attached to the swing body 102. A front wire rope (hereinafter referred to as a front rope 110*a*) is wound around the front winch 110 and the front rope 110*a* is connected to the boom hook 106 over a top part of the boom 103. Actuation of the front winch 110 causes the front rope 110*a* to be wound up or fed out so that the boom hook 106 moves upwardly or downwardly, respectively.

A rear wire rope (hereinafter referred to as a rear rope 111*a*) is wound around the rear winch 111 and the rear rope 111*a* is connected to the jib hook 105 over the top part of the boom 103 and the tip end of the jib 104. Actuation of the rear winch 111 causes the rear rope 111*a* to be wound up or fed out so that the jib hook 105 moves upwardly or downwardly, respectively.

A mast 107 is rotatably supported on a front part of the swing body 102, and the tip end of the mast 107 and the top part of the boom 103 are connected to each other with a pendant rope 115. A wire rope for hoisting/lowering (hereinafter referred to as a boom hoist rope 112*a*) is wound around the boom hoist winch 112. The boom hoist rope 112*a* is wound a plurality of times between sheaves 121 provided behind the boom hoist winch 112 and sheaves 122 provided in the tip end of the mast 107. Actuation of the boom hoist winch 112 causes the boom hoist rope 112*a* to be wound up or fed out so that the mast 107 rotates to hoist or lower the boom 103 via the pendant rope 115.

A jib hoist winch 113 is provided on a back side of the boom 103 and a jib hoist rope 113*a* is wound around the jib hoist winch 113. A front post 108 and a rear post 109 are swingably or rotatably attached to the tip end of the boom 103. The front post 108 is arranged between the jib 104 and the rear post 109 and linked to the tip end of the jib 104 via a pendant rope 116 (a linking member).

Sheaves 123 are provided at a tip end of the front post 108 and sheaves 124 are provided at a tip end of the rear post 109. The jib hoist rope 113*a* for hoisting/lowering the jib is wound a plurality of times between the sheaves 123 of the front post 108 and the sheaves 124 of the rear post 109. Actuation of the jib hoist winch 113 causes the jib hoist rope 113*a* to be wound up or fed out so that the front post 108 rotates with respect to the rear post 109 to hoist or lowers the jib 104 via the pendant rope 116.

The tip end of the rear post 109 and a bracket 139 in the vicinity of a base end of the boom 103 are linked to each other with a rear post support pendant 140 that can be divided. The rear post support pendant 140 can be divided into a post-side pendant member 141 and a boom-side pendant member 142.

The post-side pendant member 141 is rotatably attached, on one end, to a pin 109*b* (see FIG. 2) in the tip end of the rear post 109. The other end of the post-side pendant member 141 is attached to one end of the boom-side pendant member 142. The boom-side pendant member 142 is rotatably attached, on the other end, to the bracket 139 in the vicinity of the base end of the boom 103.

It will be noted that the rear post support pendant 140 is constructed of components that are linked to one another, such as a plurality of rod-like pendant members (bar pendants) and/or pendant members formed of wire ropes (pendant ropes). In this embodiment, the post-side pendant member 141 is a rod-like bar pendant, and a component of the boom-side post pendant member 142 that is coupled to the post-side pendant member 141 is a rod-like bar pendant.

Generally, the boom 103, the jib 104, and other components are separately transported in a disassembled manner by a trailer to a working site and assembled to form the crane 100 in the working site. In the assembly task, an operator attaches the front post 108 and the rear post 109 to the tip end side of the boom 103, while the boom 103 extends in a generally horizontal manner with respect to the ground.

After attaching the front post 108 and the post 109 to the boom 103, the operator connects the post-side pendant member 141 which is connected to the rear post 109 and the boom-side pendant member 142 which is connected to the boom 103. Thereafter, the operator attaches the jib 104 to the boom 103 with an auxiliary crane or the like.

A configuration of a post driving device 150 that is used for attaching the post-side pendant member 141 to the boom-side pendant member 142 will now be described in detail. The post driving device 150 is provided in the tip end of the boom 103.

Figure 2:
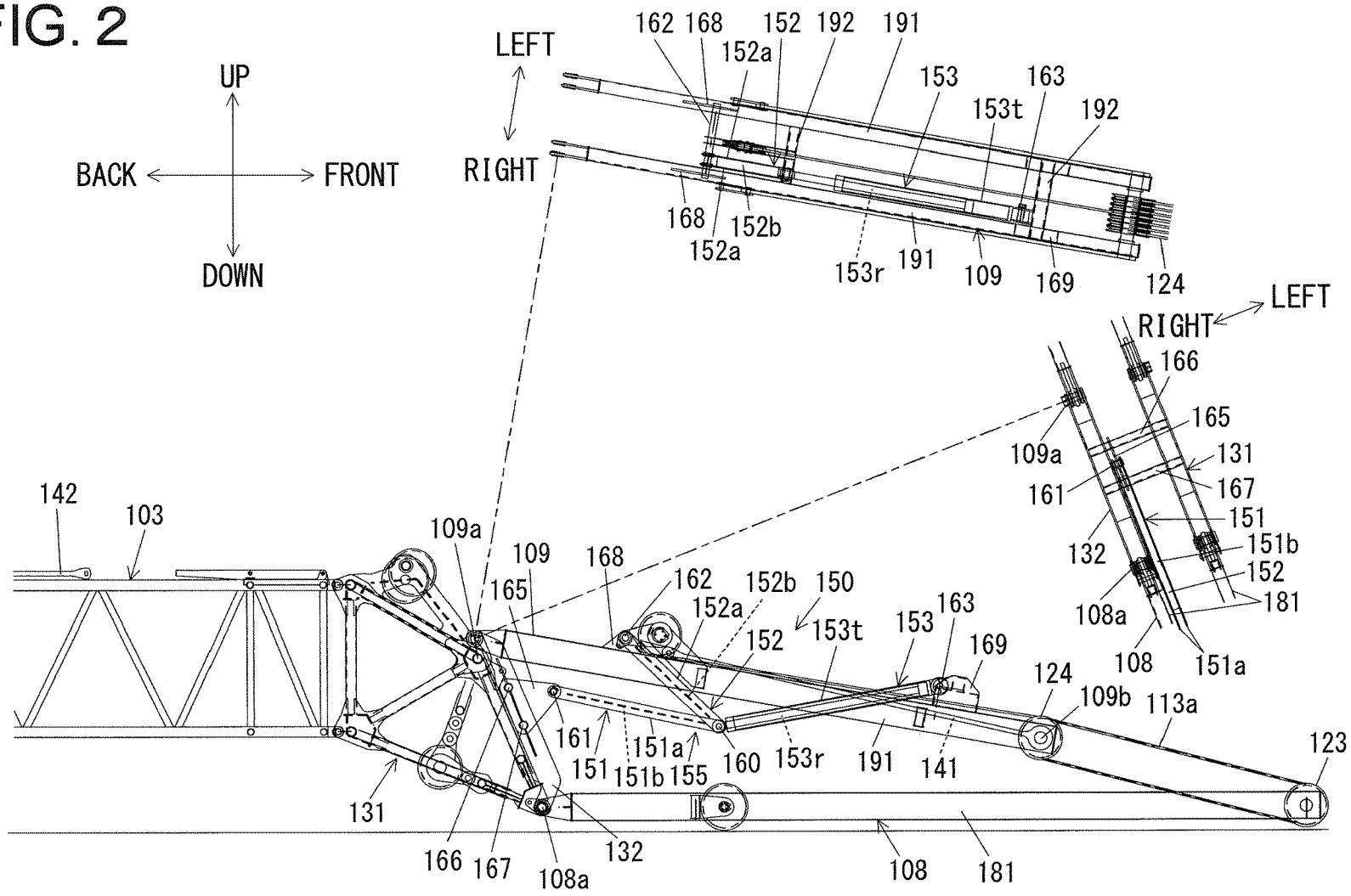
FIG. 2 is a view showing a tip end of a boom.

FIG. 2 is a view showing the tip end of the boom 103. It will be noted that outlines of components are schematically represented by solid lines in side schematic views shown in FIGS. 2 to 14, for the sake of convenience. As shown in FIG. 2, the boom 103 is provided with a boom head 131 that forms the tip end of the boom 103. In the illustration of FIG. 2, the boom 103 is swung down so that a ventral surface thereof faces to the ground and the boom 103 is generally horizontally arranged to extend in the front-back direction.

As shown in FIG. 2, a pair of right and left post fixing members 132 having a predetermined length is provided in the top part of the boom head 131, extending from a base end of the front post 108 to a base end of the rear post 109. The pair of right and left post fixing members 132 are coupled to each other at the center in the longitudinal direction with two support pipes 166 and 167.

The front post 108 includes a pair of columns 181 that oppose to each other in the right-left direction and extend in the longitudinal direction, and a coupling member (not shown) that couples the pair of right and left columns 181. The columns 181 are pivotably supported on one end (a lower end of the post fixing member 132 shown in FIG. 2) of the post fixing member 132 in a rotatable manner by a pin 108*a* that extends in the right-left direction.

The rear post 109 includes a pair of columns 191 that oppose to each other in the right-left direction and extend in the longitudinal direction, and coupling members 192 that couple the pair of right and left columns 191. The columns 191 are pivotably supported on the other end (an upper end of the post fixing member 132 shown in FIG. 2) of the post fixing member 132 in a rotatable manner by a pin 109*a* that extends in the right-left direction.

As shown in FIG. 2, the post driving device 150 that drives the rear post 109 to rotate is provided between the rear post 109 and the boom head 131. The post driving device 150 includes a link mechanism 155 that has a first link 151 and a second link 152, and a hydraulic cylinder 153 (an extension/retraction actuator) that drives the link mechanism 155.

The support pipes 166 and 167 that are bridged between the pair of right and left post fixing members 132 are provided with a generally triangular attaching plate 165. The support pipe 166 and the support pipe 167 are inserted in the vicinity of respective ones of two vertexes on a base side of the generally triangular attaching plate 165 (a side in which the attaching plate 165 is attached to the post fixing member 132).

In the vicinity of a vertex on a protruding side (on a tip end side) of the attaching plate 165 in the boom head 131, a base end of the first link 151 is rotatably attached by a pin 161 that extends in the right-left direction. The pin 161, which is a rotation pivot of the first link 151, is arranged between the front post 108 and the rear post 109. The structure of the first link 151 is such that a pair of right and left elongated longitudinal plates 151*a* are coupled to each other by one elongated transverse plate 151*b*.

Mounting brackets 168 are provided in a protruding manner on an upper surface of the base end side of the rear post 109 shown in FIG. 2. A pin 162 that extends in the right-left direction is bridged between the pair of right and left mounting brackets 168 in the rear post 109. The base end of the second link 152 is rotatably attached by this pin 162. The structure of the second link 152 is such that a pair of right and left elongated longitudinal plates 152*a* are coupled to each other by one elongated transverse plate 152*b*.

A cylinder support bracket 169 is provided in an upwardly protruding manner at a predetermined distance from the mounting bracket 168 of the rear post 109 toward the tip end side. The hydraulic cylinder 153 has a cylinder tube (hereinafter referred to as a tube 153*t*) and a rod 153*r* that extends/retracts with respect to the tube 153*t*.

The hydraulic cylinder 153 includes an oil chamber on the bottom side (hereinafter referred to as a bottom chamber) and an oil chamber on the rod side (hereinafter referred to as a rod chamber). The hydraulic cylinder 153 is configured to extend when hydraulic oil is supplied to the bottom chamber and retract when hydraulic oil is supplied to the rod chamber.

An end of the tube 153*t* that is one end of the hydraulic cylinder 153 is rotatably attached to the cylinder support bracket 169 of the rear post 109 by a pin 163 that extends in the right-left direction. A tip end (rod head) of the rod 153*r* that is the other end of the hydraulic cylinder 153, the tip end of the first link 151, and the tip end of the second link 152 are coupled by a coupling shaft 160 that extends in the right-left direction. In other words, the hydraulic cylinder 153, the first link 151, and the second link 152 are coupled to be rotatable relative to one another about the coupling shaft 160 as a rotation center.

The link mechanism 155 that is constructed of the first link 151 and the second link 152 is actuated by means of the extension/retraction operation of the hydraulic cylinder 153, with a rotation radius restricted by the first link 151. The rear post 109 is driven to rotate about a pin 109*a* by actuation of the link mechanism 155.

Figure 3:
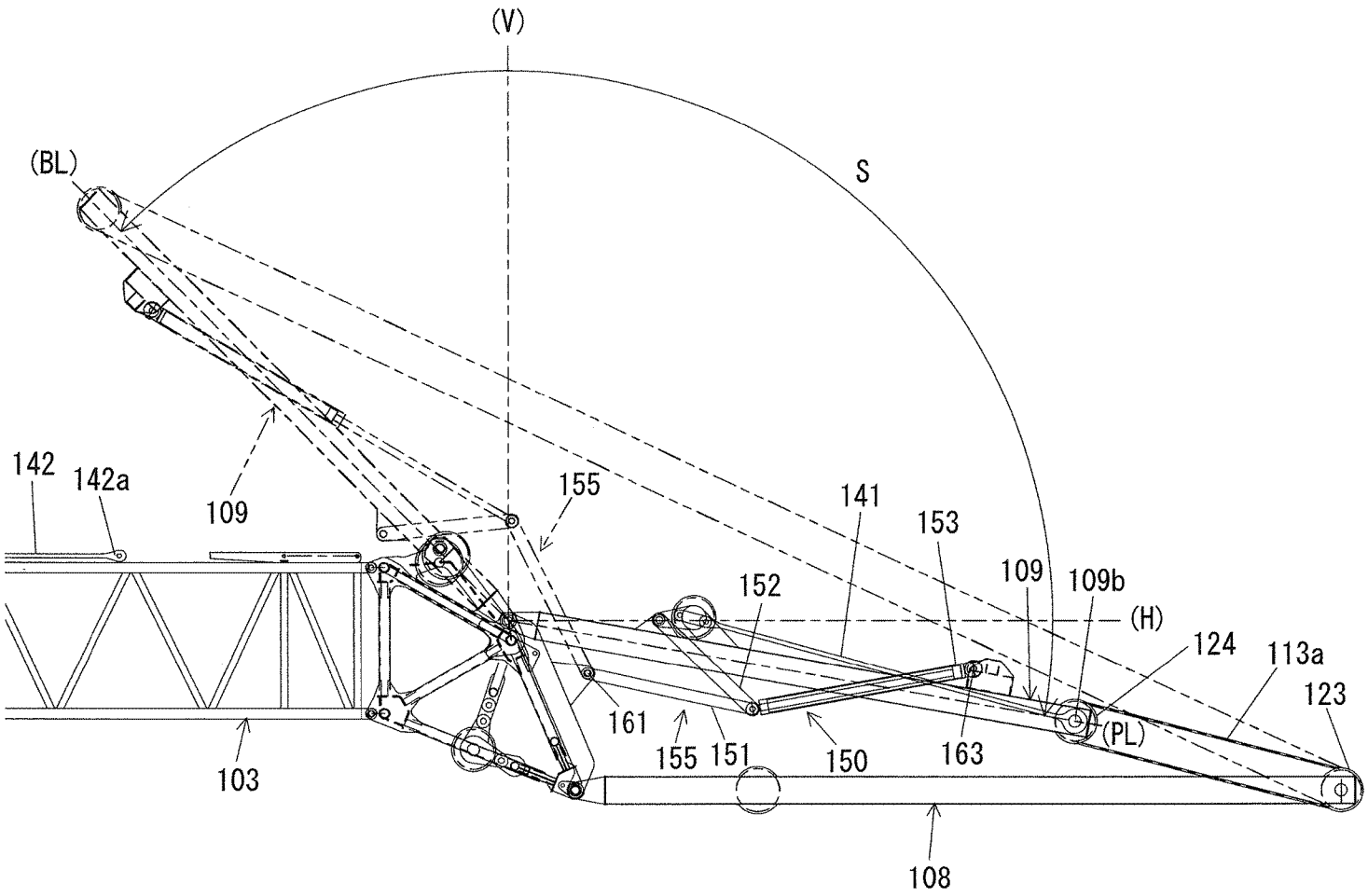
FIG. 3 is a schematic view showing a rotating range of a rear post that is rotated by a post driving device.

FIG. 3 is a schematic view showing a rotating range of the rear post 109 that is rotated by the post driving device 150. The link mechanism 155 is configured to rotate the rear post 109 in a range including a position (PL) at which the rear post 109 is swung down to the front post 108 side as represented by solid lines in FIG. 3 and a position (BL) at which the rear post 109 is swung down to the boom 103 side as represented by long dashed double-short dashed lines in FIG. 3, while the boom 103 is swung down in a horizontal position. The position (PL) at which the rear post 109 is swung down is a position at which the rear post 109 is tilted to the front post 108 side beyond the vertical direction (V), and the position (BL) at which the rear post 109 is swung down is a position at which the rear post 109 is tilted to the boom 103 side beyond the vertical direction (V).

When a task of winding the jib hoist rope 113*a* between the sheaves 123 and the sheaves 124 is performed, it is preferable in view of workability to bring the sheaves 124 of the rear post 109 and the sheaves 123 of the front post 108 as close as possible to each other and bring the sheaves 124 of the rear post 109 closer to the ground. For this reason, the front post-side limit position (PL) of the rotating range S of the rear post 109 is set to a position at which the rear post 109 is tilted by approximately 10 degrees toward the front post 108 from a position at which the rear post 109 is arranged in parallel to the boom 103, i.e., from the horizontal direction (H). The rear post 109 is in the front post-side limit position (PL) when the hydraulic cylinder 153 is retracted to the maximum extent, while the boom 103 is swung down in a horizontal position.

The boom-side limit position (130 of the rotating range S of the rear post 109 is set so that the rear post 109 is swung down to the boom 103 side until one end of the boom-side pendant member 142 attached to the boom 103 and the other end of the post-side pendant member 141 attached to the tip part of the rear post 109 can be attached to each other. The rear post 109 is in the boom-side limit position (PL) when the hydraulic cylinder 153 is extended to the maximum extent, while the boom 103 is swung down in a horizontal position.

In this embodiment, the boom-side limit position (BL) of the rotating range S of the rear post 109 is set to a position at which the rear post 109 is tilted by approximately 45 degrees toward the boom 103 from a position at which the rear post 109 is arranged orthogonally to the boom 103, i.e., from the vertical direction (V).

In this way, the rear post 109 is rotated by the post driving device 150 so as to go beyond the vertical direction (V), while the boom 103 is swung down in a horizontal position.

In this embodiment, the rotating range S is set to approximately 145 degrees in such a manner that the rotating range S includes at least a position (H) at which the rear post 109 extends in the horizontal direction and a position (V) at which the rear post 109 extends in the vertical direction. In this way, the rear post 109 can be rotated between a position at which a task of winding the jib hoist rope 113*a* between the sheaves 123 and the sheaves 124 can be performed, and a position at which a task of attaching the boom-side pendant member 142 to the post-side pendant member 141 can be performed.

A task of attaching the front post 108 and the rear post 109 to the boom 103 and a task of attaching the post-side pendant member 141 to the boom-side pendant member 142, among assembly tasks of the crane 100, will be described below. It will be noted that the boom-side pendant member 142 is disposed on the boom 103 as shown in FIG. 3 so that a connecting end 142*a* thereof for connection to the post-side pendant member 141 is arranged on the rear post 109 side.

Figure 4A:
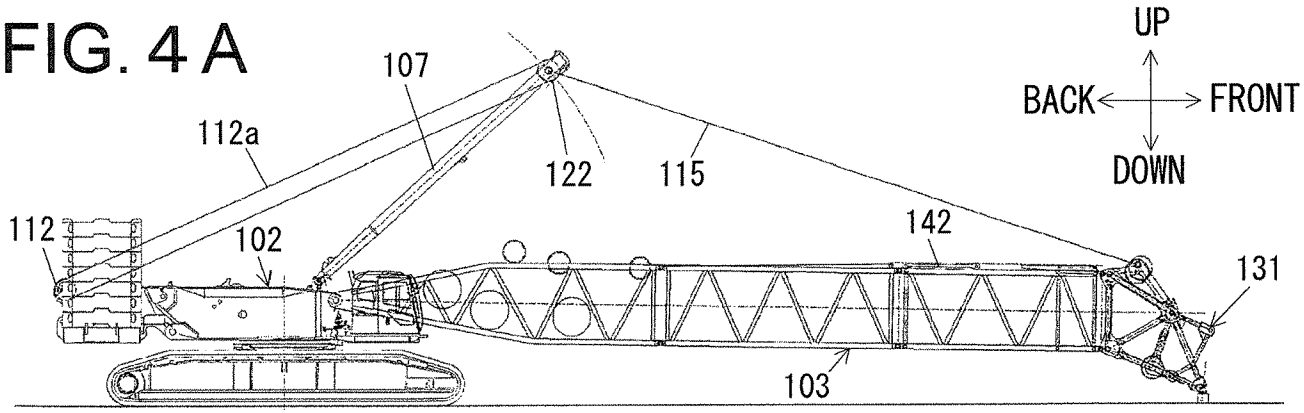
FIGS. 4A, 4B are views explaining a task of attaching a front post to the boom.
Figure 4B:
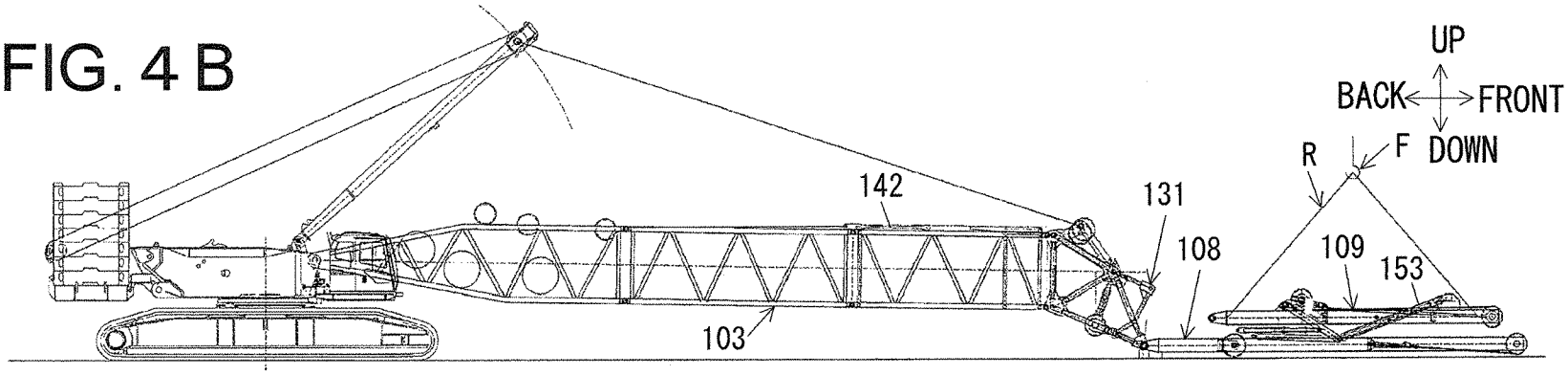

FIGS. 4A and 4B are views explaining the task of attaching the front post 108 to the boom 103. As shown in FIG. 4A, the operator actuates the boom hoist winch 112 to swing the boom 103 down so that the boom 103 is in a horizontal position, by operating a control lever for boom hoisting/lowering.

As shown in FIG. 4B, the operator uses an auxiliary crane to lift up the front post 108 so that the base end of the front post 108 is attached to the boom head 131. Thereafter, the operator uses the auxiliary crane to lift up the rear post 109. As shown in this figure, ropes R that are suspended from a hook F of the auxiliary crane are attached to both ends of the rear post 109. It will be noted that the hydraulic cylinder 153 has been previously retracted to its shortest length. Additionally, the post-side pendant member 141 has been previously rotatably attached to the tip end of the rear post 109 by a pin 109*b* (see FIG. 3), on one end. The other end of the post-side pendant member 141 is fixed to the rear post 109 by a fixing device (not shown) so that the member 141 would not rotate with one end being as a rotation pivot.

Figure 5A:
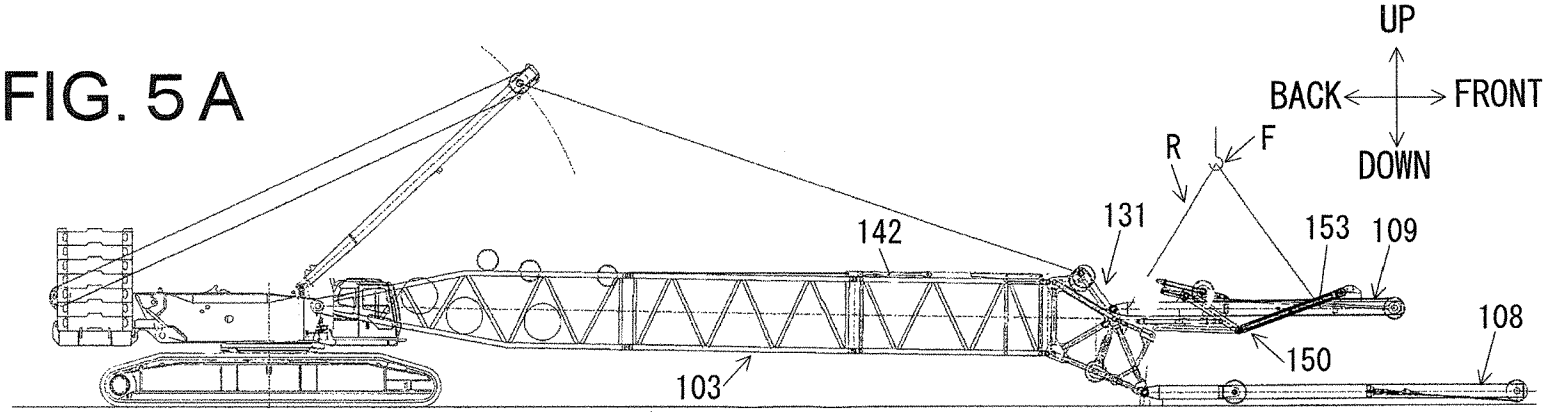
FIGS. 5A, 5B are views explaining a task of attaching the rear post to the boom.
Figure 5B:
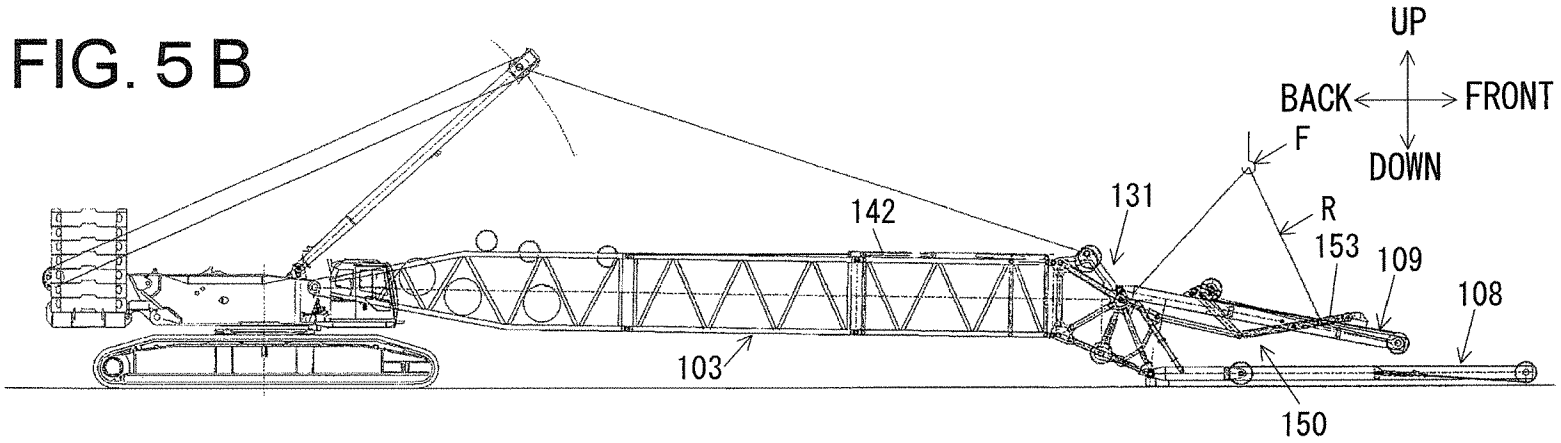

FIGS. 5A and 5B are views explaining a task of attaching the rear post 109 to the boom 103. After lifting up the rear post 109 using the auxiliary crane, the operator attaches the base end of the rear post 109 to the post fixing member 132 of the boom head 131 (see FIG. 2), as shown in FIG. 5A. Thereafter, the operator sets a fitting angle of the rear post 109 to an angle at which the rear post 109 is supported by the post driving device 150, as shown in FIG. 5B.

Figure 6A:
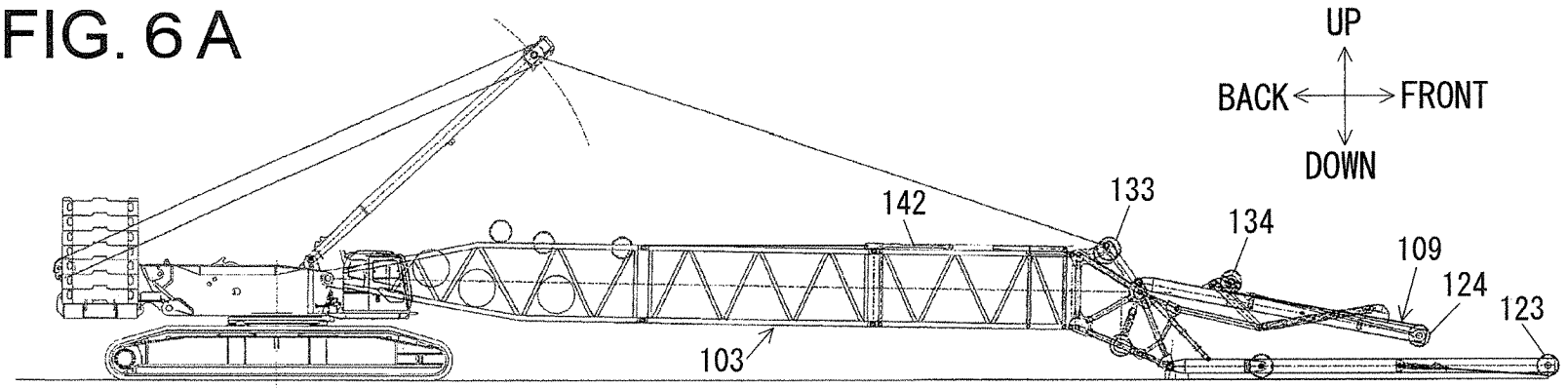
FIGS. 6A, 6B are views explaining a task of winding a jib hoist rope between sheaves of a front post and sheaves of a rear post.
Figure 6B:
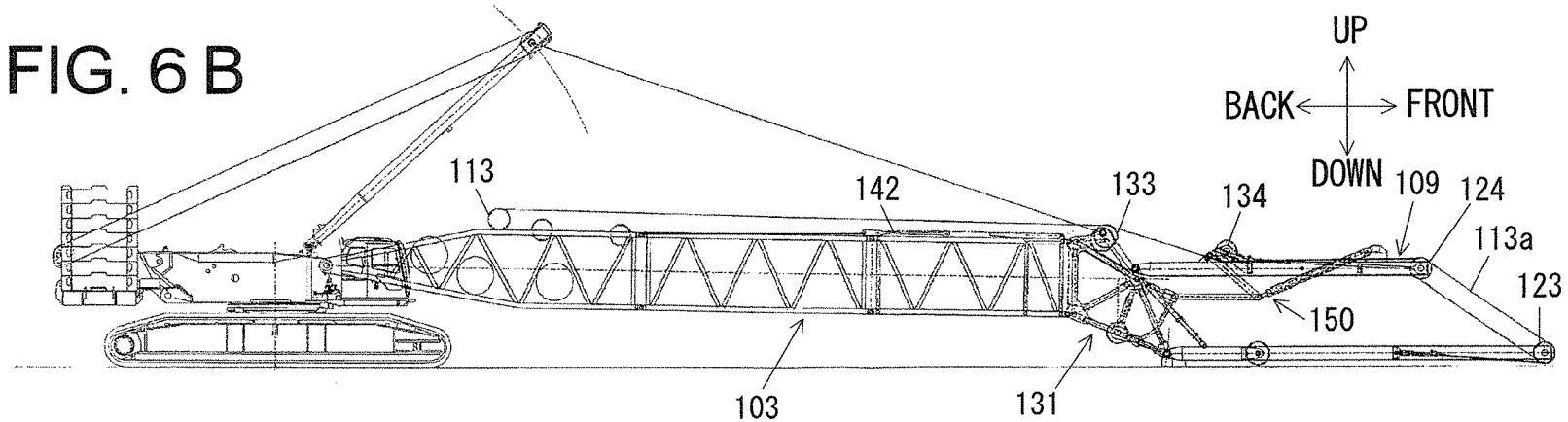

FIGS. 6A and 6B are views explaining a task of winding the jib hoist rope 113*a* around the sheaves 123 of the front post 108 and the sheaves 124 of the rear post 109. After setting the fitting angle of the rear post 109, the operator removes the ropes R that are suspended from the hook F of the auxiliary crane, as shown in FIG. 6A. At this time, the distance between the sheaves 123 of the front post 108 and the sheaves 124 of the rear post 109 and the distance between the sheaves 124 and the ground are shorter than that in the state of FIG. 5A (the state where the rear post 109 is horizontally arranged).

As shown in FIG. 6B, the operator pulls the jib hoist rope 113*a* out of the jib hoist winch 113, using a reeving winch or the like (not shown). The operator guides the jib hoist rope 113*a* which is pulled out of the jib hoist winch 113 to the sheaves 124, via a guide sheave 133 provided in the boom head 131 and a guide sheave 134 provided in the rear post 109. Thereafter, the operator winds the jib hoist rope 113*a* between the sheaves 124 and the sheaves 123 a plurality of times, and then fixes an end of the jib hoist rope 113*a* at a predetermined position on the rear post 109 or the front post 108.

FIGS. 7 to 12 are views explaining how the rear post 109 is driven to rotate by the post driving device 150. Before the hydraulic cylinder 153 is driven, the hydraulic cylinder 153 and a hydraulic power source (not shown) are connected to each other. Between the hydraulic cylinder 153 and the hydraulic power source (not shown), a switching valve unit (not shown) that switches flow of hydraulic oil discharged from the hydraulic power source is provided. The operator can operate the switching valve unit (not shown) so as to supply the hydraulic oil discharged from the hydraulic power source to either the rod chamber or the bottom chamber of the hydraulic cylinder 153.

Figure 7:
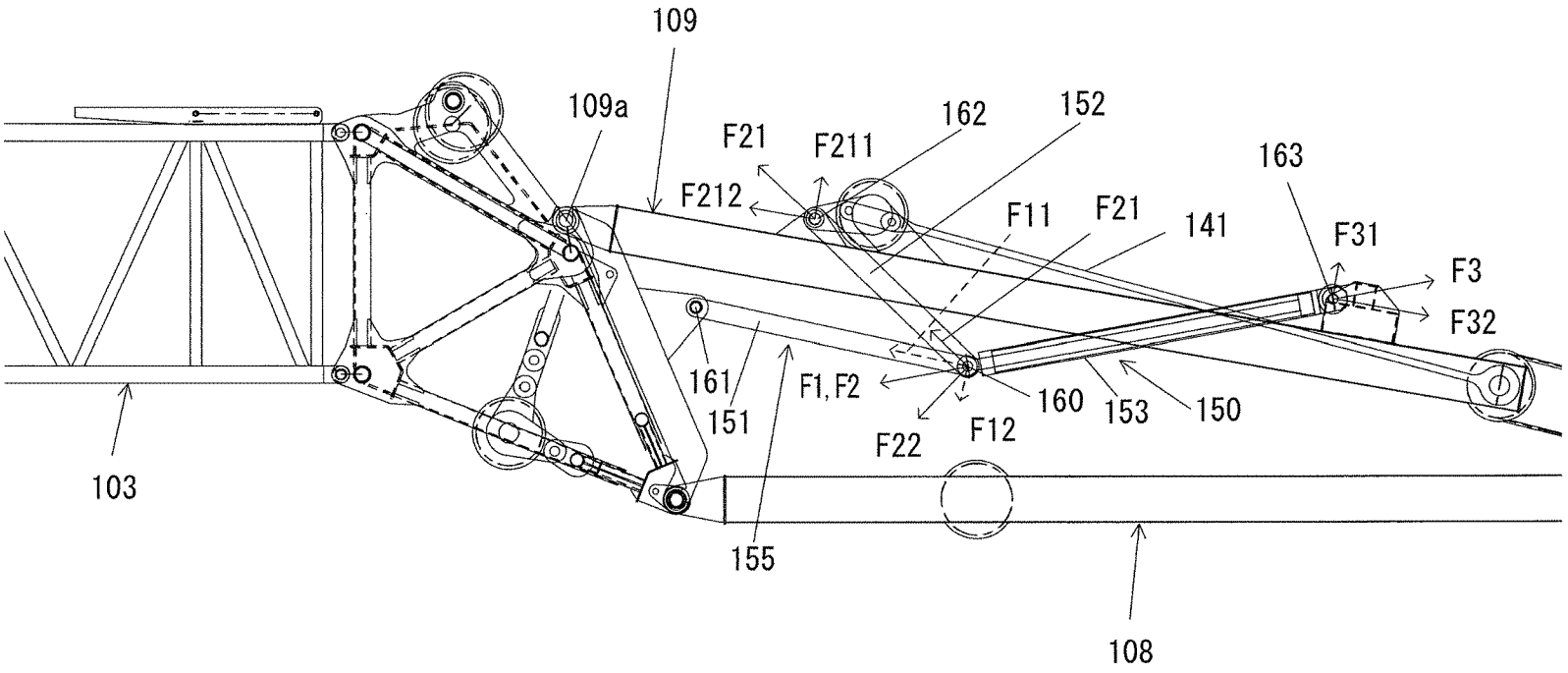
FIG. 7 is a view explaining how the rear post driven to rotate by the post driving device.
Figure 8:
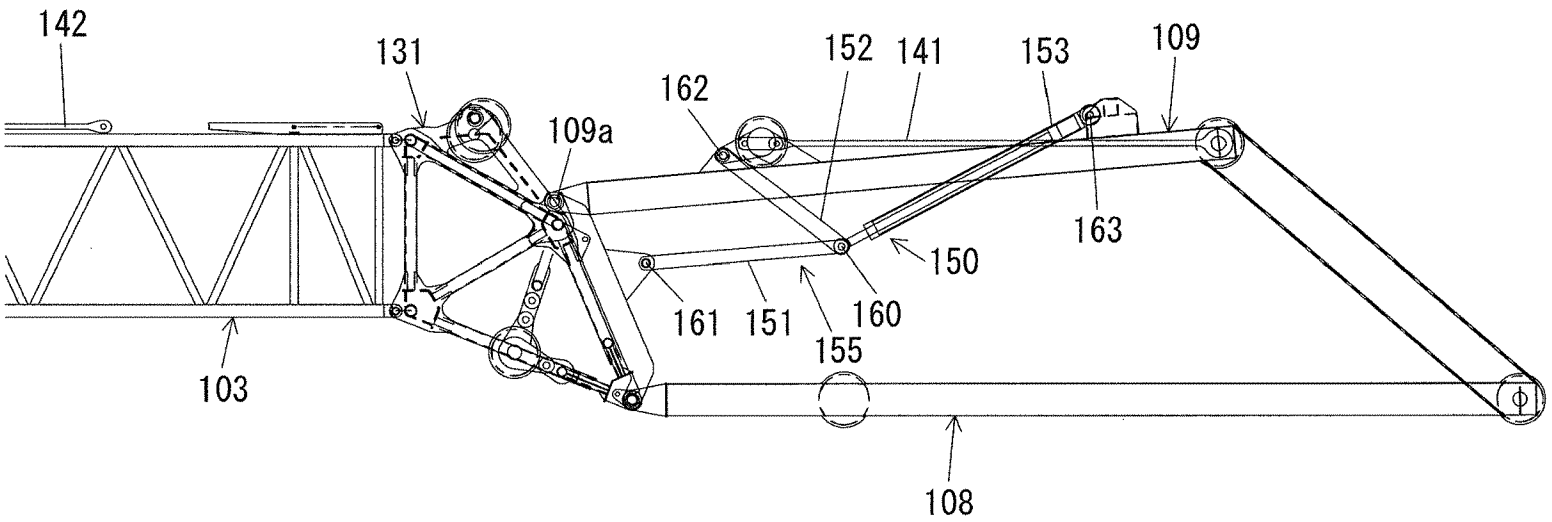
FIG. 8 is a view explaining how the rear post is driven to rotate by the post driving device.
Figure 9:
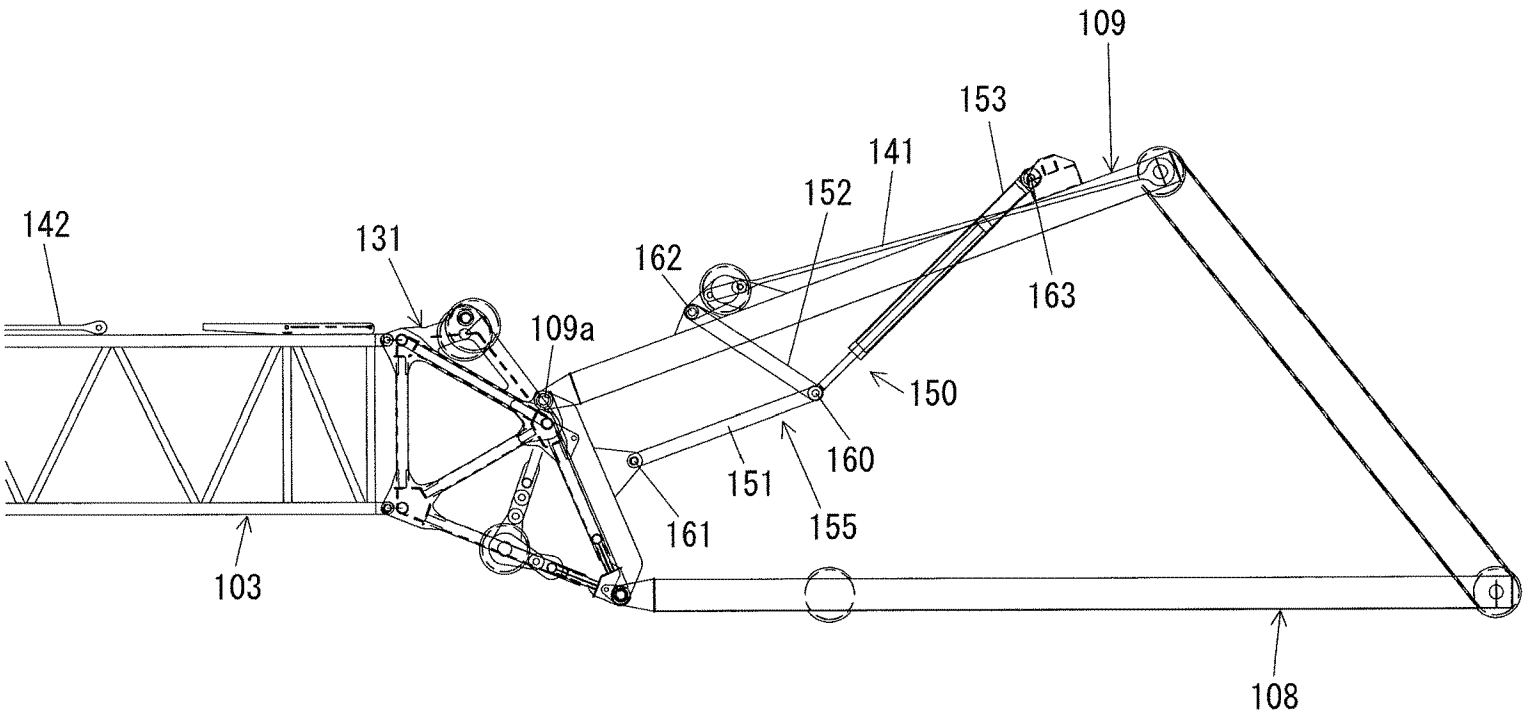
FIG. 9 is a view explaining how the rear post is driven to rotate by the post driving device.
Figure 10:
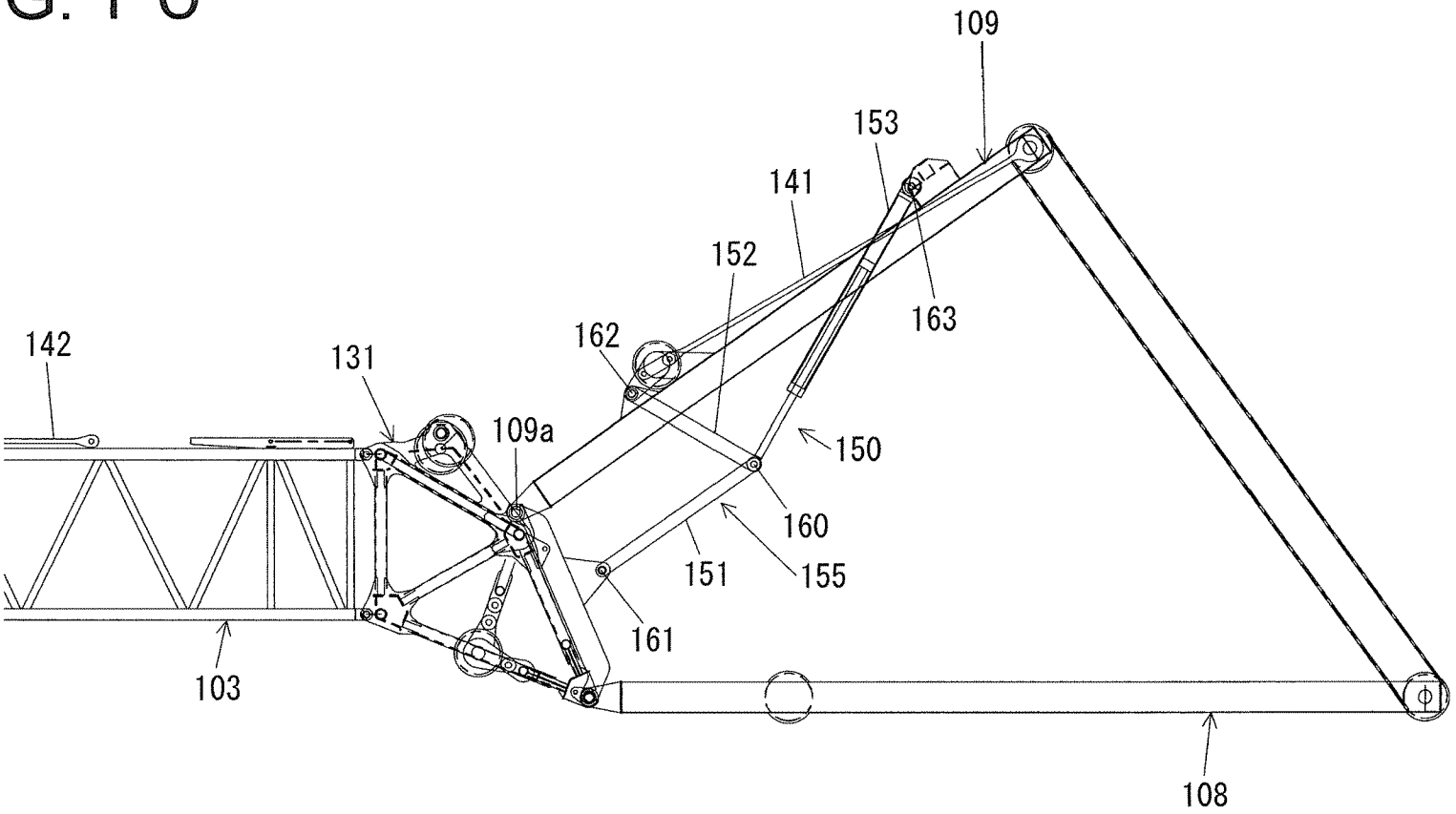
FIG. 10 is a view explaining how the rear post is driven to rotate by the post driving device.
Figure 11:
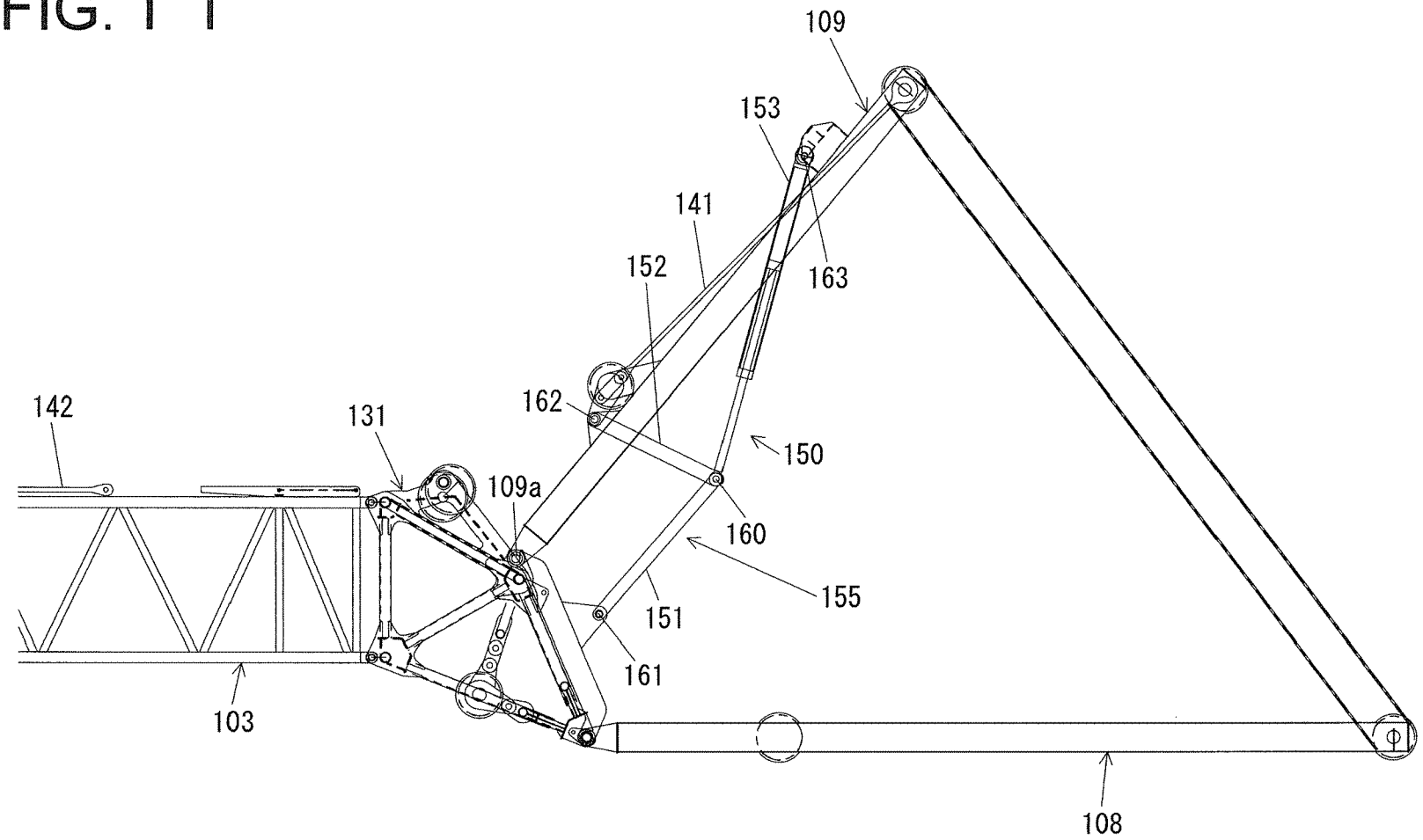
FIG. 11 is a view explaining how the rear post is driven to rotate by the post driving device.

The bottom chamber of the hydraulic cylinder 153 in its shortest state shown in FIG. 7 is supplied with the hydraulic oil from the hydraulic power source (not shown), while the hydraulic oil is discharged from the rod chamber and guided to a tank (not shown). When the bottom chamber of the hydraulic cylinder 153 is supplied with the hydraulic oil, a cylinder thrust acts on each of the first link 151 and the second link 152 via the coupling shaft 160, while a cylinder thrust acts on the rear post 109 via the pin 163.

The cylinder thrust F1 acting on the first link 151 is decomposed into a force F11 that directs to the pin 161, which is the rotation center of the first link 151, and a force F12 that urges the first link 151 to rotate. It will be noted that rotation of the first link 151 is restricted by the second link 152 even when the three F12 acts on the first link 151.

The cylinder thrust F2 acting on the second link 152 is decomposed into a force F21 that directs to the pin 162, which is the rotation center of the second link 152, and a force F22 that urges the second link 152 to rotate. It will be noted that rotation of the second link 152 is restricted by the first link 151 even when the force F22 acts on the second link 152.

The force F21 which directs to the rotation center of the second link 152 acts on the pin 162. The force F21 acting on the pin 162 is decomposed into a rotating force F211 that acts to cause the rear post 109 to rotate about the pin 109*a* as a rotation center, and a force F212 that is orthogonal to the rotating force F211.

The cylinder thrust F3 acting on the rear post 109 via the pin 163 is decomposed into a force F31 that acts to cause the rear post 109 to rotate about the pin 109*a* as a rotation center, and a force F32 that is orthogonal to the rotating force F31.

Figure 12:
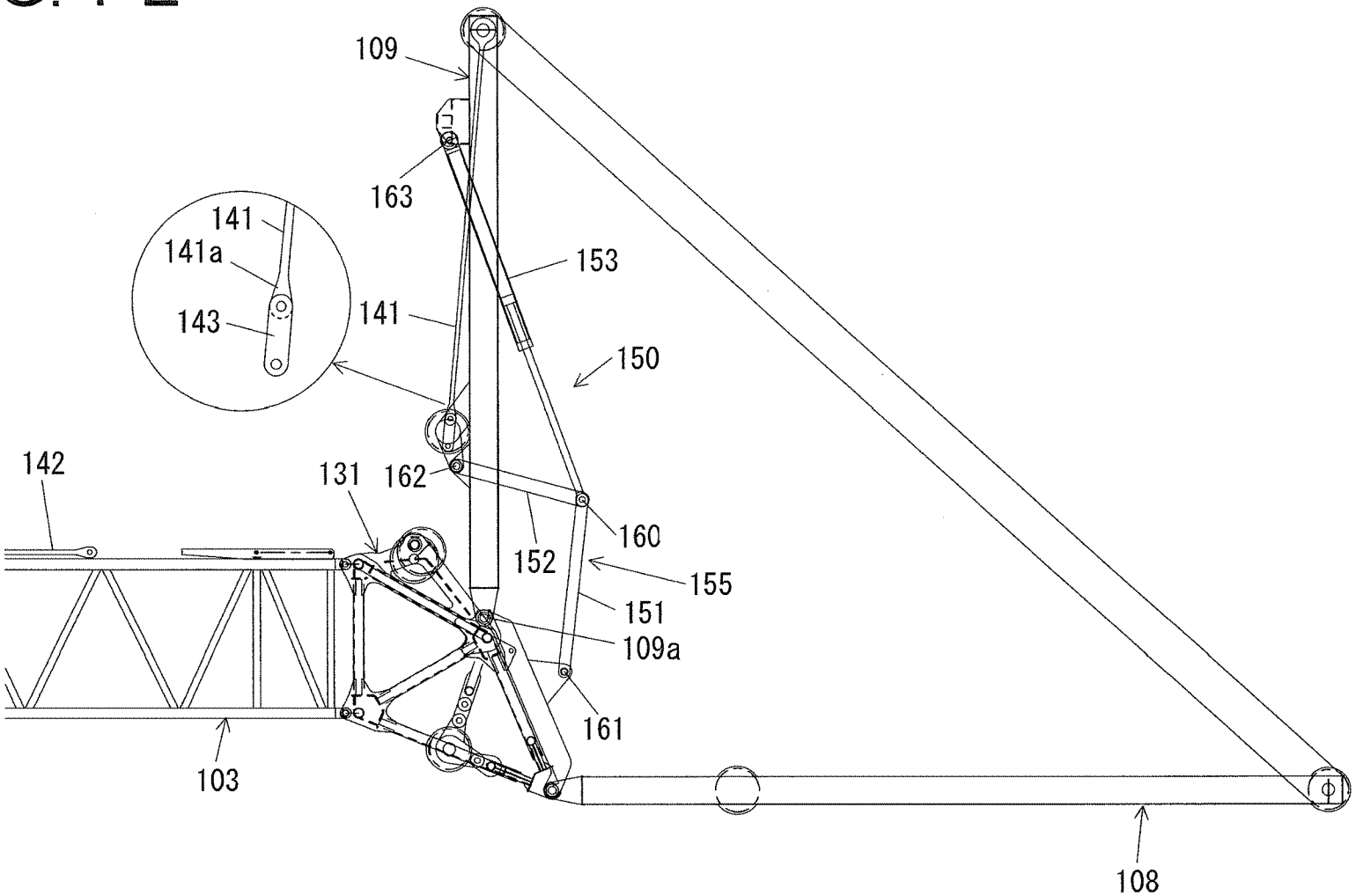
FIG. 12 is a view explaining how the rear post is driven to rotate by the post driving device.

Therefore, when the bottom chamber of the hydraulic cylinder 153 is supplied with the hydraulic oil, the rotating force F31 and the rotating force F211 which are generated by the thrust of the hydraulic cylinder 153 act on the rear post 109, so that the rear post 109 rotates about the pin 109*a* as a rotation center in a counterclockwise direction in FIG. 7. In other words, the position of the rear post 109 shifts from the position shown in FIG. 7 to the position shown in FIG. 8, the position shown in FIG. 9, the position shown in FIG. 10, the position shown in FIG. 11, and the position shown in FIG. 12 sequentially, so that the rear post 109 raises up. FIG. 12 shows a state where the rear post 109 has raised up, extending in the vertical direction.

Figure 13A:
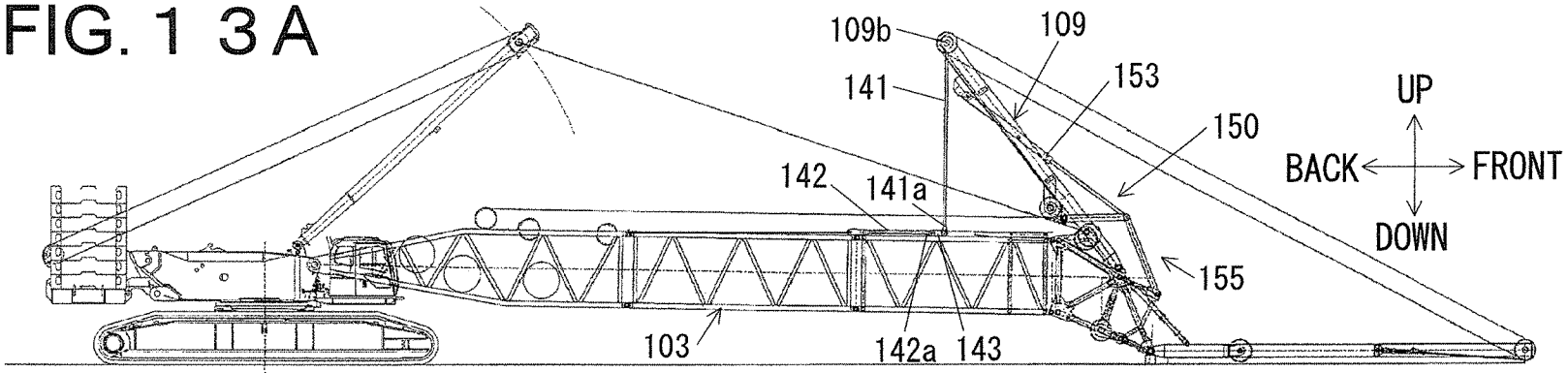
FIGS. 13A, 13B are views explaining a task of attaching a post-side pendant member to a boom-side pendant member.
Figure 13B:
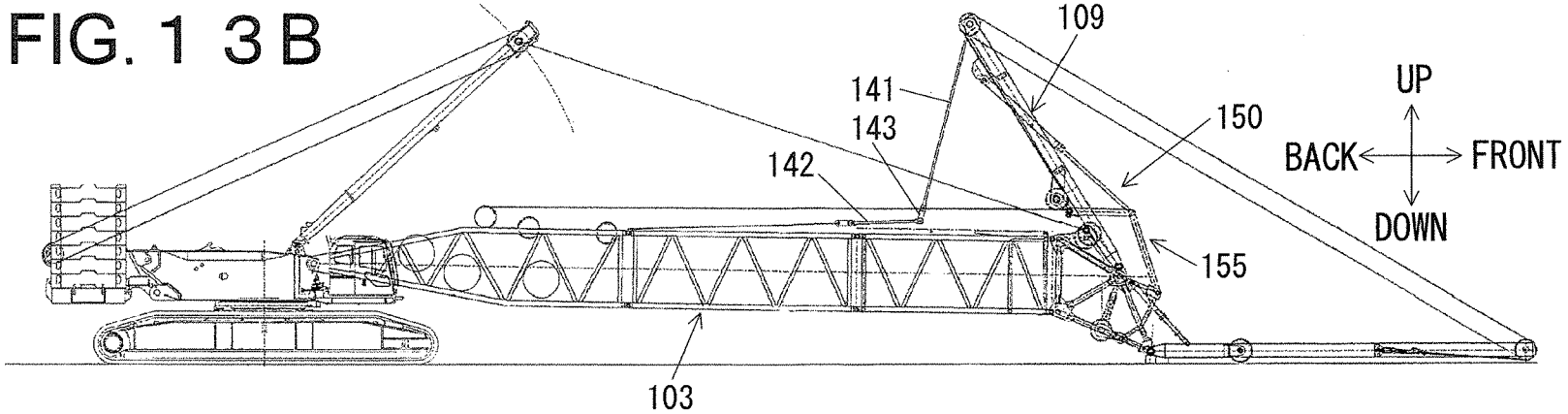

FIGS. 13A and 13B are views explaining the task of attaching the post-side pendant member 141 to the boom-side pendant member 142. From the state shown in FIG. 12, the rear post 109 swings (tilts) to the boom 103 side so as to shift its position to that shown in FIG. 13A, when the bottom chamber of the hydraulic cylinder 153 is further supplied with the hydraulic oil.

The operator releases the fixation of the bottom end of the post-side pendant member 141 to swing the post-side pendant member 141 about the pin 109*b* as a rotation center, so that a connecting end 141*a* of the post-side pendant member 141 is connected to the connecting end 142*a* of the boom-side pendant member 142 via a metal connecting fitting 143.

The connecting fitting 143 is a coupling member that is provided with through holes on both ends. As shown in an enlarged schematic view of FIG. 12, a pin has been previously inserted and attached into one through hole of the connecting fitting 143 and a through hole of the connecting end 141 a so that the connecting fitting 143 is rotatably attached to the post-side pendant member 141.

As shown in FIGS. 13A and 13B, the operator inserts and attaches a pin into the other through hole of the connecting fitting 143 and a through hole of the connecting end 142*a* to rotatably couple the boom-side pendant member 142 to the connecting fitting 143. Thereby, the post-side pendant member 141 and the boom-side pendant member 142 are linked to each other.

Figure 14:
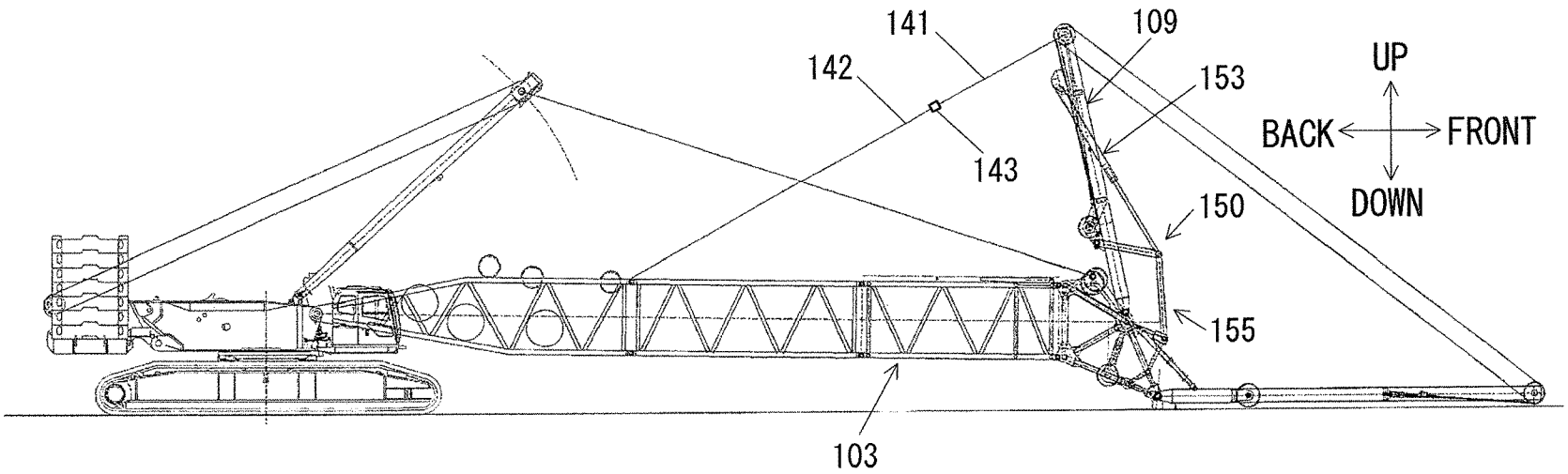
FIG. 14 is a view explaining a task of tensioning the post-side pendant member and the boom-side pendant member.

FIG. 14 is a view explaining a task of stretching out (tensioning) the post-side pendant member 141 and the boom-side pendant member 142. The operator operates the switching valve unit so that the hydraulic oil discharged from the hydraulic power source (now shown) is supplied to the rod chamber of the hydraulic cylinder 153. The operator causes the hydraulic oil to be supplied to the rod chamber of the hydraulic cylinder 153 in order to retract the hydraulic cylinder 153. Thereby, the rear post 109, which has been swung down to the boom 103 side, raises up so that the post-side pendant member 141 and the boom-side pendant member 142 are tensioned as shown FIG. 14. Thereafter, the operator proceeds to a task of attaching the jib 104 to the boom 103.

According to the embodiment described above, the following operational advantages can be achieved.

(1) There is provided the post driving device 150 having the link mechanism 155 that rotates the rear post 109 in a range including a position (PL) at which the rear post 109 is swung down to the front post 108 side and a position (BL) at which the rear post 109 is swung down to the boom side 103, while the boom 103 is swung down in a horizontal position. Thereby, the rear post 109 that is attached to the boom 103 which has been swung down in a horizontal position can be raised up and further swung down to the boom 103 side without using the auxiliary crane. In this way, the rear post 109 that is attached to the boom 103 which has been swung down in a horizontal position, and that is swung down to the front post 108 side, can be raised up and further swung down to the boom 103 side without using the auxiliary crane. As a result, an improvement in the assembly and disassembly workability of the crane can be achieved.

(2) The post driving device 150 is provided so that the rear post 109 rotates in a range including a position (H) at which the rear post 109 is arranged in parallel to the boom 103 and a position (V) at Which the rear post 109 is arranged orthogonally to the boom 103. Because the rear post 109 can be swung down to the front post 108 side beyond the position (H) at which the rear post 109 is arranged in parallel to the boom 103, an improvement in the workability of winding the jib hoist rope 113*a* between the sheaves 123 and the sheaves 124 can be achieved.

The following variations are also within the scope of the present invention and one or more of the variations may be combined with the foregoing embodiment.

First Variation

In the foregoing embodiment, an example has been described in which the first link 151 and the second link 152 are connected or attached with the rod head of the hydraulic cylinder 153 in a rotatable manner about the coupling shaft 160. However, the present invention is not limited to this. The first link 151 and the second link 152 may be connected or attached with the end of the tube 153*t* of the hydraulic cylinder 153 in a rotatable manner about the coupling shaft 160, and the rod head of the hydraulic cylinder 153 may be connected to the rear post 109.

Second Variation

In the foregoing embodiment, an example has been described in which the front post 108 is rotatably attached to the boom head 131. However, the present invention is not limited to this. For example, the bottom of the front post 108 may be attached to the base part of the jib 104.

Third Variation

In the foregoing embodiment, an example has been described in which the hydraulic cylinder 153 is used as a driving power source of the post driving device 150. However, the present invention is not limited to this. For example, a linear type extension/retraction actuator including an electric motor and a feed screw mechanism may be employed.

Fourth Variation

The post-side pendant member 141 and the boom-side pendant member 142 are not limited to be rod-like bar pendants, but may be formed of wire ropes.

Fifth Variation

In the foregoing embodiment, the movable crane 100 having the travel body 101 has been described. However, the present invention is not limited to this. A fixed crane may also be applied.

Although an embodiment and variations have been described above, the present invention is not limited to these forms. Other aspects that are conceivable within the scope of the technical idea of the present invention are also encompassed within the scope of the present invention.

According to the embodiment and variations of the present invention described above, the rear post that is attached to the boom which has been swung down in a horizontal position and that is swung down to the front post side, can be raised up and further swung down to the boom side without using the auxiliary crane.

What is claimed is:

1. A crane comprising:

a boom;

a jib that is attached to the boom so that the jib can be hoisted or lowered;

a front post that is swingably attached to a tip end side of the boom and linked to the jib via a linking member;

a rear post that is swingably attached to the tip end side of the boom, wherein a rope for hoisting or lowering the jib is wound between the rear post and the front post;

a post-side pendant member, with one end of the post-side pendant member being attached to a tip end of the rear post;

a boom-side pendant member, with one end of the boom-side pendant member being attached to another end of the post-side pendant member, and another end of the boom-side pendant member being attached to the boom; and a post driving device having a link mechanism that rotates the rear post in a range including a position at which the rear post is swung down to a front post side and a position at which the rear post is swung down to a broom side, while the boom is held down in a horizontal position, wherein the post driving device is configured to:

include an extension/retraction actuator, with one end of the extension/retraction actuator being connected to the rear post;

be designed so that the rear post rotates in a range including a position at which the rear post is arranged in parallel to the boom by retraction of the extension/retraction actuator and a position at which the rear post is arranged orthogonally to the boom by extension of the extension/retraction actuator; and when the extension/retraction actuator is extended, the rear post is swung down to the boom side until the one end of the boom-side pendant member attached to the boom and the other end of the post-side pendant member attached to the tip end of the rear post can be attached to each other.

2. The crane according to claim 1, wherein the link mechanism has a first link and a second link, with one end of each of the first link and the second link being attached with another end of the extension/retraction actuator to be rotatable about a coupling shaft;

another end of the first link is rotatably attached to a tip end of the broom; and another end of the second link is rotatably attached to the rear post.

3. The crane according to claim 2, wherein the another end of the first link is rotatably attached to the tip end of the boom between the rear post and the front post.

4. The crane according to claim 3, wherein the tip end of the boom between the rear post and the front post is provided with a triangular attaching plate, and the other end of the first link is rotatably attached to a vicinity of a vertex of the attaching plate.

5. The crane according to claim 1, wherein the post driving device is further configured so that the rear post rotates in a range from a position at which the rear post is arranged closer to the front post side than the position at which the rear post is arranged in parallel to the boom by retraction of the extension/retraction actuator to a position at which the rear post is arranged closer to a boom side than the position at which the rear post is arranged orthogonally to the boom by extension of the extension/retraction actuator.

6. The crane according to claim 5, wherein a rotating range from the position at which the rear post is arranged closer to the front post side than the position at which the rear post is arranged in parallel to the boom by retraction of the extension/retraction actuator to the position at which the rear post is arranged closer to the boom side than the position at which the rear post is arranged orthogonally to the boom by extension of the extension/retraction actuator is set to be 145 degrees.

* * * * *